United States Patent [19]

Russell

[11] Patent Number: 4,967,436

[45] Date of Patent: Nov. 6, 1990

[54] COMBINATION LID REMOVAL TOOL

[76] Inventor: Donald W. Russell, 231 North Ave., Plain City, Ohio 43064

[21] Appl. No.: 451,649

[22] Filed: Dec. 18, 1989

[51] Int. Cl.[5] ..... B25F 1/00

[52] U.S. Cl. ..... 7/156; 81/3.57; 7/105; 7/164

[58] Field of Search ..... 7/151, 105, 156, 164, 7/166, 167; 81/3.09, 3.55, 3.57

[56] References Cited

U.S. PATENT DOCUMENTS

| | | | |
|---|---|---|---|
| 952,827 | 3/1910 | Martin, Sr. | 81/3.56 |
| 3,119,424 | 1/1964 | Henry | 7/167 X |
| 3,495,284 | 2/1970 | Weingardt | 7/151 |
| 3,604,289 | 9/1971 | Steel | 81/3.42 |
| 4,028,758 | 6/1977 | O'Conner | 7/167 X |
| 4,030,150 | 6/1977 | Fisher | 7/167 X |
| 4,409,863 | 10/1983 | Anderson | 7/151 |
| 4,507,988 | 4/1985 | Lo Faso et al. | 81/3.09 |
| 4,658,455 | 4/1987 | Skillern | 7/151 X |

*Primary Examiner*—James G. Smith
*Attorney, Agent, or Firm*—Leon Gilden

[57] ABSTRACT

A tool is set forth defined by generally planar sides, including a central handle defined by a concave top surface overlying an undulating convex bottom surface. The tool includes an enlarged head at a forward end of the handle defined by a "C" shaped cavity with a first leg defined by an arcuate interior surface spaced from a second leg defined by a planar exterior surface, wherein each leg includes a ledge spaced from a planar rear surface defining the "C" shaped cavity. A blade member is mounted extending orthogonally outwardly and longitudinally of the head portion for prying of various lids and tabs, wherein the first leg provides a bucket lid receiving cavity within a lower portion of the "C" shaped cavity defined between the first leg and the rear surface of the cavity. A modification of the instant invention includes a longitudinally reciprocatable cutting blade mounted within a rear portion of the handle and may further include the forward blade threadedly removable from the head portion of the tool. A reciprocatably mounted measuring tape is slidably retractable and extensible longitudinally of an upper surface of the handle. A further modification of the instant invention may include a loop member securing a "Y" shaped flexible line, wherein each leg of the flexible line includes a hook member thereon to engage a forward edge of a lid to retain the lid relative to the tool once removed from an associated container.

1 Claim, 4 Drawing Sheets

FIG 1
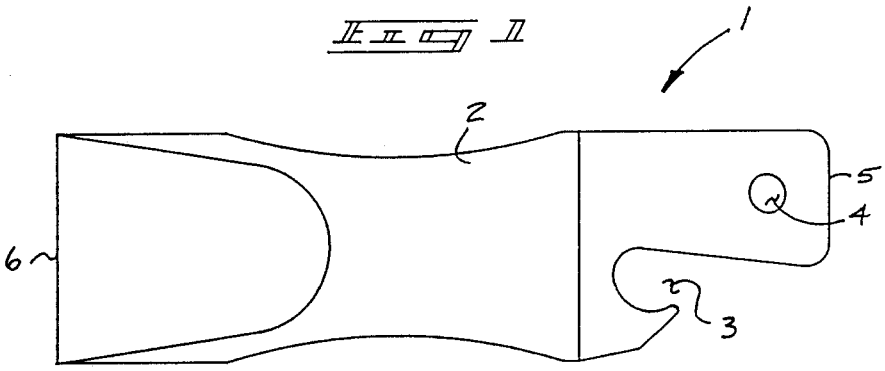
PRIOR ART
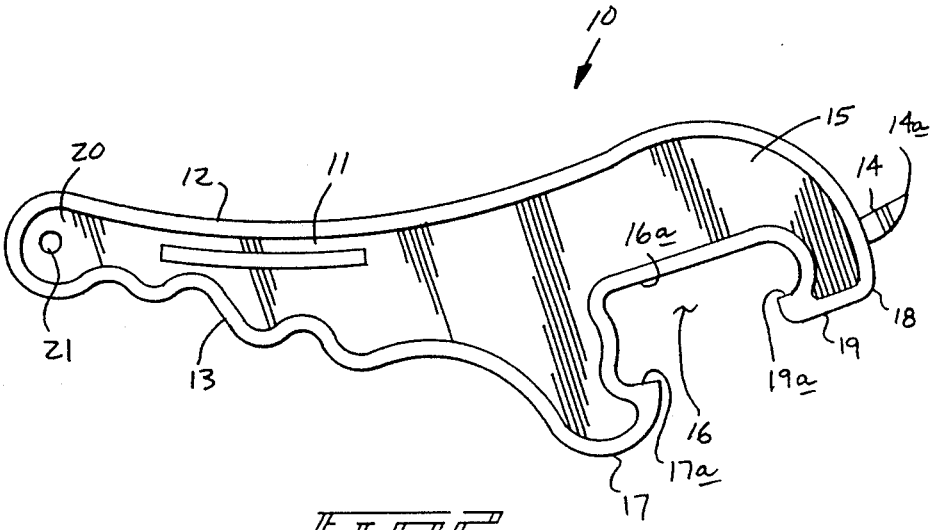
FIG 2

COMBINATION LID REMOVAL TOOL

BACKGROUND OF THE INVENTION

1. Field of the Invention

The field of invention relates to lid removal tools, and more particularly pertains to a new and improved combination lid removal tool wherein the same provides for removal of lids and tabs relative to containers.

2. Description of the Prior Art

The use of lid removal tools and the like are well known in the prior art. The use of such tools have been developed to conveniently remove tabs and lids relative to beverage containers, paint cans, and the like. The instant invention attempts to overcome deficiencies of the prior art by providing such a tool with cooperative structure to remove various lids and the like in a convenient and readily manipulatable tool member. Examples of the prior art include U.S. Pat. No. 4,409,863 to Anderson which sets forth a multiple tool opener for use with flip-top cans wherein a forward end of the opener includes a hook-like section for opening flip-top type cans spaced from a generally elliptical shaped opening in the rear section for securement of such tabs.

U.S. Pat. No. 4,507,988 to LoFaso wherein a generally upper fixed jaw is spaced from a lower fixed jaw with a ribbed member spaced therebetween for securement and opening of flip-top type beverage containers.

U.S. Pat. No. 952,827 to Martin sets forth a closure removal tool wherein a generally forward hook member is spaced from a rear hook member with a pivoted section therebetween for grasping and removal of cap members to bowls and the like.

U.S. Pat. No. 3,604,289 to Steel sets forth a grasping device wherein an elongate bar includes a hook member at its forward end and a ratcheting levered member at the rear end to grasp lids for their twisting removal from an associated container.

U.S. Pat. No. 3,495,284 to Weingartd sets forth a container opening device wherein a series of openings through the body of the device is provided for the directing of an individual's fingers therethrough, with a plurality of hooks mounted at a forward end of the tool for the grasping and removal of various lids to enable their removal from an associated container.

As such, it may be appreciated that there is a continuing need for a new and improved combination lid removal tool wherein the same addresses both the problems of ease of use and effectiveness in construction and in this respect, the present invention substantially fulfills this need.

SUMMARY OF THE INVENTION

In view of the foregoing disadvantages inherent in the known types of lid removal tools now present in the prior art, the present invention provides a combination lid removal tool wherein the same provides a "C" shaped opening, as well as a blade member and associated structure, for the removal and repositioning of lids relative to associated containers. As such, the general purpose of the present invention, which will be described subsequently in greater detail, is to provide a new and improved combination lid removal tool which has all the advantages of the prior art lid removal tools and none of the disadvantages.

To attain this, the present invention includes a tool defined by generally planar sides, including a central handle defined by a concave top surface overlying an undulating convex bottom surface. The tool includes an enlarged head at a forward end of the handle defined by a "C" shaped cavity with a first leg defined by an arcuate interior surface spaced from a second leg defined by a planar exterior surface, wherein each leg includes a ledge spaced from a planar rear surface defining the "C" shaped cavity. A blade member is mounted extending orthogonally outwardly and longitudinally of the head portion for prying of various lids and tabs, wherein the first leg provides a bucket lid receiving cavity within a lower portion of the "C" shaped cavity defined between the first leg and the rear surface of the cavity. A modification of the instant invention includes a longitudinally reciprocatable cutting blade mounted within a rear portion of the handle and may further include the forward blade threadedly removable from the head portion of the tool. A reciprocatable mounted measuring tape is slidably retractable and and extensible longitudinally of an upper surface of the handle. A further modification of the instant invention may include a loop member securing a "Y" shaped flexible line, wherein each leg of the flexible line includes a hook member thereon to engage a forward edge of a lid to retain the lid relative to the tool once removed from an associated container.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved combination lid removal tool which has all the advantages of the prior art lid removal tools and none of the disadvantages.

It is another object of the present invention to provide a new and improved combination lid removal tool which may be easily and efficiently manufactured and marketed.

It is a further object of the present invention to provide a new and improved combination lid removal tool which is of a durable and reliable construction.

An even further object of the present invention is to provide a new and improved combination lid removal tool which is susceptible of a low cost of manufacture with regard to both materials and labor, and which accordingly is then susceptible of low prices of sale to the consuming public, thereby making such combination lid removal tools economically available to the buying public.

Still yet another object of the present invention is to provide a new and improved combination lid removal tool which provides in the apparatuses and methods of the prior art some of the advantages thereof, while simultaneously overcoming some of the disadvantages normally associated therewith.

Still another object of the present invention is to provide a new and improved combination lid removal tool wherein the same provides for enhanced manual grasping of an elongate longitudinally arranged handle of the tool associated with a forwardly mounted head, wherein the head includes a "C" shaped opening as well as a blade for the removal of various lids and tabs from containers.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is an orthographic side view taken in elevation of a prior art lid removal tool.

FIG. 2 is an orthographic view taken in elevation of the lid removal tool of the instant invention.

DESCRIPTION OF THE PREFERRED EMBODIMENT

Figure 3:
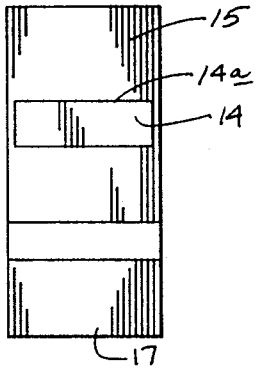
FIG. 3 is an orthographic end view taken in elevation of a forward end of the lid removal tool.

With reference now to the drawings, and in particular to FIGS. 1 to 8 thereof, a new and improved combination lid removal tool embodying the principles and concepts of the present invention and generally designated by the reference numerals 10, **10*a*, 10*b*, and 10*c*** will be described.

FIG. 1 is illustrative of a typical prior art device 1 defined by a longitudinally extending handle 2 formed with a forward head defined by a generally "J" shaped hook member with an aperture 4 formed within the head 5 for securement of the head during periods of non-use. The rear portion of the handle 2 includes a perimeter lip 6 defining an opening to engage tabs of tab opening type beverage container.

More specifically, the combination lid removal tool 10, and illustrated in FIG. 2, essentially comprises a body defined by generally spaced parallel sides defining a central handle 11 with a concave top surface 12 spaced from a convex undulating bottom surface 13 to form finger grasping depressions therewithin to enhance manual grasping of the tool. An elongate pry blade 14 extends orthogonally and longitudinally of the handle 11 integrally mounted to the head portion 15 formed integrally with the handle 11 at a forwardmost end thereof, wherein the pry blade 14 defines an elongate edge **14*a*, as illustrated in FIG. 3. The head portion 15 includes a "C" shaped cavity 16 spaced interiorly of the bottom surface and forwardly of the bottom surface 13 of the handle, wherein the cavity includes a first leg 17 defining an arcuate exterior surface with a first ledge 17*a* defining an interior bottom surface of the "C" shaped cavity 16, wherein the "C" shaped cavity defines a generally planar elongate rear surface that is spaced generally longitudinally of the arcuate handle and head 11 and 15, with the first ledge 17*a* spaced from a second ledge 19*a* that is defined by a downwardly projecting second leg 19, wherein the second leg 19 includes a planar exterior surface spaced from the arcuate surface of the first leg 17. The arcuate interior surface of the first leg 17 defines a curvilinear fulcrum for use with the first ledge 17*a* grasping a lid between the ledge 17*a* and the rear surface 16*a*, wherein the planar exterior surface of the second leg merges with a forward curvilinear surface of the head 15 to define a forward fulcrum 18 when a lid member is received between the first ledge 17*a* and the rear surface 16*a* and is pivoted about the forward fulcrum 18 with the planar surface 19 defining clearance for the forward fulcrum 18. In construction, the second ledge 19*a* is spaced adjacent the first ledge 17*a* to accommodate grasping lids of various thicknesses within the "C" shaped cavity 16. A rear arcuate end 20 is formed at a rearwardmost end of the handle 11 to enable application of manual pressure against the rear curvilinear end surface or arcuate end 20, with a securement aperture 21 orthogonally directed through the rear portion of the handle 11** to provide for storage of the tool during periods of non-use upon a nail or the like.

Figure 4:
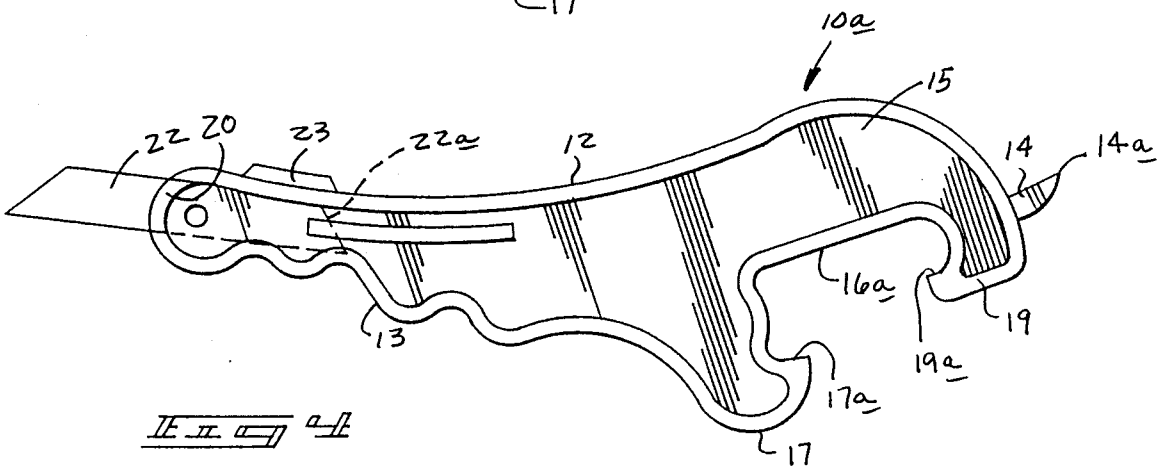
FIG. 4 is an orthographic side view taken in elevation of a modified lid removal tool of the instant invention.

FIG. 4 is illustrative of the second combination removal tool **10*a* utilized by the instant invention, including a reciprocatably mounted blade 22 received within a blade cavity 22*a* within the rear arcuate end 20 of the tool, wherein an actuator slide 23 mounted to the top concave surface 12 reciprocates the blade 22 relative to the blade cavity 22*a***.

Figure 5:
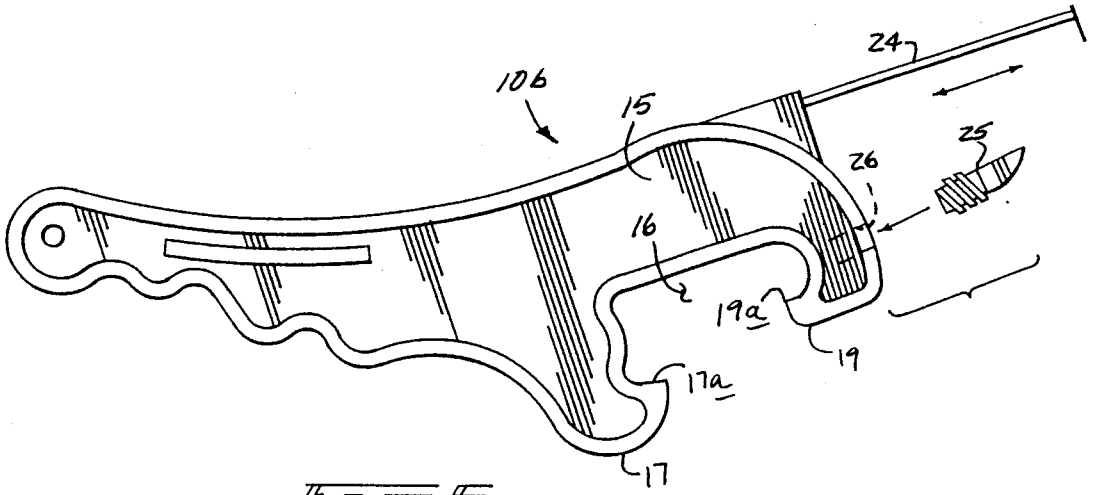
FIG. 5 is an orthographic side view taken in elevation of a further modified lid removal tool of the instant invention.
Figure 6:
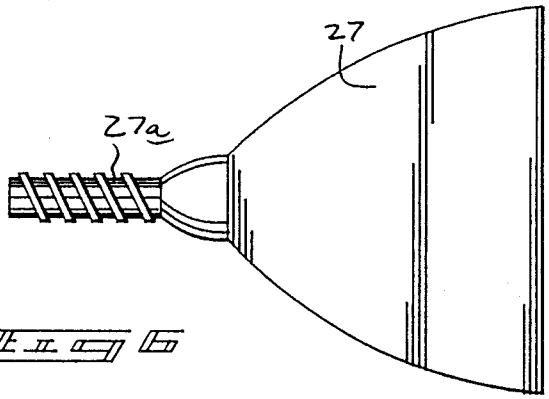
FIG. 6 is a top orthographic view of a replaceable scraper blade for use with the lid removal tool of FIG. 5.

FIG. 5 illustrates a third lid removal tool **10*b* wherein a tape measure 24 is reciprocatably received within a forward upper end of the head portion 15, and wherein the blade member 25 includes a threaded shank receivable within a threaded cavity 26 orthogonally mounted to the head portion 15 and aligned with the "C" shaped cavity 16. In this manner, various blades may be utilized, such as a triangular scraper blade 27, including a threaded shank 27***a* that may be replaceably mounted within the threaded cavity 26 to enable multi-purpose use of the tool in various work environments.

Figure 7:
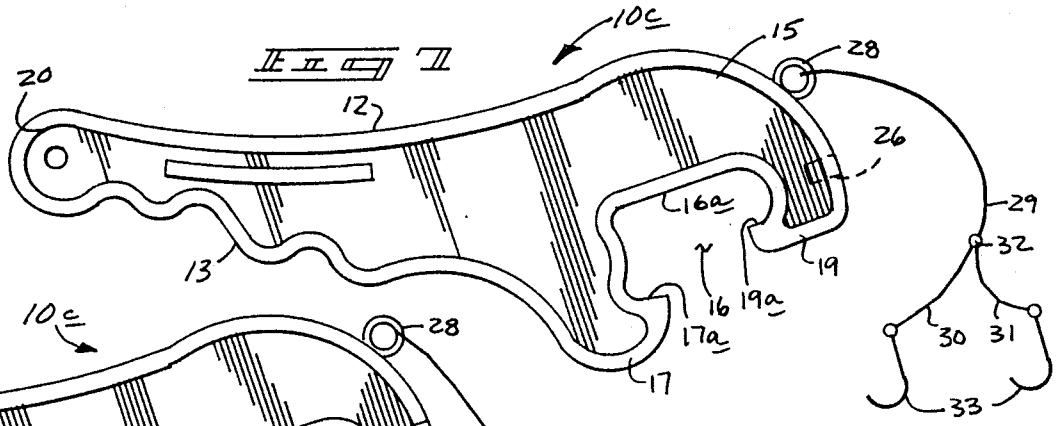
FIG. 7 is an orthographic side view taken in elevation of a yet further lid removal tool of the instant invention.
Figure 8:
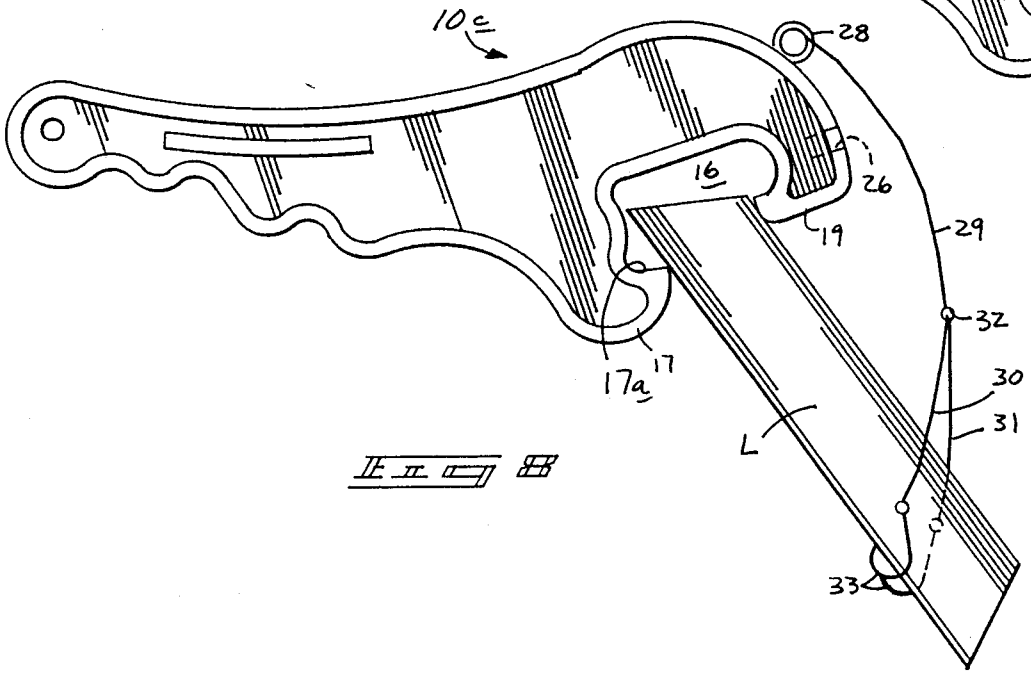
FIG. 8 is an orthographic side view taken in elevation of the lid removal tool of FIG. 7 in association with a container lid.

FIGS. 7 and 8 illustrate a fourth combination lid removal tool 10*c* wherein a securement loop 28 mounted to a forward arcuate edge of the head portion 15 includes a first line 29 mounted thereto, wherein the first line includes a central loop 32 that mounts a second and third separate line 30 and 31, wherein hook members 33 are mounted to remote terminal ends of the second and third lines 30 and 31 spaced from the central loop 32. In use, the hooks 33 are mounted to forward portions of a lid "L" that is grasped between the first ledge 17*a* within the cavity 16, whereby the lid "L" is retained relative to the tool and its removal from an associated container. The first, second, and third lines 31 are formed of a resilient memory retentent stretchable line material to enable stretching of the lines and associated hooks relative to the lid "L" to enable combination of various lids of various configurations and diameters.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A combination lid removal tool comprising, a longitudinally aligned central body defined by spaced planar sides, and a central handle portion positioned medially of the body, wherein the body includes a concave arcuate upper surface and an undulating bottom surface underlying the handle portion, wherein the undulating bottom surface defines finger recesses therewithin, and a head member defined forwardly of the handle portion, and a first leg member positioned adjacent to and extending below the bottom surface underlying the head member, and a second leg member spaced forwardly of the first leg member extending below the head member, wherein a central cavity defined between the first and second leg members, and a blade member longitudinally aligned with the body and extending forwardly of the head member, and an arcuate rear end portion longitudinally aligned with and defined at a rearwardmost end of the handle portion, wherein the end portion includes an arcuate exterior surface, and wherein the central cavity is defined by a generally "C" shaped configuration with a planar rear surface, and a first ledge spaced from the planar rear surface defined on an upper end portion of the first leg member, and a second ledge spaced from the planar rear surface formed to an upper end portion of the second leg member, and wherein the first leg member defines an arcuate interior surface and the second leg member defines a planar exterior surface, and wherein the blade member includes a threaded shank, and the head portion includes a threaded bore to threadedly receive the blade member, and further including a triangular spatula blade replaceably mounted within the threaded bore, and further including a reciprocatable blade receivable within a blade cavity mounted within the handle portion extending rearwardly of the rear arcuate surface, and further including an actuator slide mounted slidably on the arcuate upper surface to reciprocate the blade relative to the blade cavity, and further including a tape measure reciprocatably mounted within the central body and extending forwardly of the head member, and wherein a loop is mounted to a forward arcuate surface of the head member, and the loop includes a first line mounted thereto, the first line including a central ring mounted to a forward terminal end of the first line, and a second line and a third line mounted at their rear terminal ends to the central ring, and hook mounted to respective forward end portions of the second and third lines, and the first line, second line, and third line are formed of a resilient memory retentent material.

* * * * *